US007735961B2

(12) United States Patent
Koyama et al.

(10) Patent No.: US 7,735,961 B2
(45) Date of Patent: Jun. 15, 2010

(54) LIQUID DISCHARGE HEAD AND METHOD OF PRODUCING THE SAME

(75) Inventors: Shuji Koyama, Kawasaki (JP); Yoshinori Tagawa, Yokohama (JP); Kenji Fujii, Kawasaki (JP); Hiroyuki Murayama, Kawasaki (JP); Masaki Ohsumi, Yokosuka (JP); Jun Yamamuro, Yokohama (JP); Yoshinobu Urayama, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 909 days.

(21) Appl. No.: 11/551,084

(22) Filed: Oct. 19, 2006

(65) Prior Publication Data

US 2007/0091147 A1 Apr. 26, 2007

(30) Foreign Application Priority Data

Oct. 20, 2005 (JP) ..... 2005-305810

(51) Int. Cl.
*B41J 2/205* (2006.01)

(52) U.S. Cl. ..... 347/40; 347/63

(58) Field of Classification Search ..... 347/40, 347/43, 12, 15, 63–65, 44–45, 49
See application file for complete search history.

(56) References Cited

U.S. PATENT DOCUMENTS

| | | | | |
|---|---|---|---|---|
| 5,204,689 | A * | 4/1993 | Shirato et al. | 347/58 |
| 5,208,604 | A * | 5/1993 | Watanabe et al. | 347/47 |
| 5,478,606 | A | 12/1995 | Ohkuma | |

FOREIGN PATENT DOCUMENTS

| | | |
|---|---|---|
| JP | 60-161973 | 8/1985 |
| JP | 64-009216 | 1/1989 |
| JP | 02-140219 | 5/1990 |
| JP | 63-221121 | 9/1998 |

* cited by examiner

*Primary Examiner*—Lamson D Nguyen
(74) *Attorney, Agent, or Firm*—Canon USA Inc IP Div

(57) ABSTRACT

A liquid discharge head including an energy generating element configured to generate energy required for discharging a liquid, a substrate having the energy generating element formed thereon, and an orifice member provided on the substrate and including a plurality of discharge ports facilitating discharging the liquid and a plurality of flow paths communicating respectively with the plurality of discharge ports. The orifice member is constituted by a first resin forming a portion connected to at least the substrate and a second resin connected to the first resin and forming the plurality of discharge ports, and the first resin includes a silane material in a larger amount than the second resin.

3 Claims, 6 Drawing Sheets

LIQUID DISCHARGE HEAD AND METHOD OF PRODUCING THE SAME

BACKGROUND OF THE INVENTION

1. Field of the Invention

The present invention relates to a liquid discharge head, and more particularly, to an ink jet recording head performing recording by discharging ink and a method of producing the ink jet recording head.

2. Description of the Related Art

As an ink jet recording head, the one having a configuration as shown in FIG. 8F has been known. The ink jet recording head has a substrate 51 on which an ink discharge energy generating element 53 capable of being constituted by a heat element or the like, for generating energy for discharging ink is formed. In the substrate 51, an ink supply port 64 for supplying ink from outside is formed as a through hole. On the substrate 51, there is connected a member forming an ink discharge port 61 disposed so as to correspond to the ink discharge energy generating element 53 and an ink flow path 65 through which communication is established from the ink supply port 64 to the ink discharge port 61.

As a method of producing such ink jet recording head, a production method including the steps of forming an ink flow path pattern with a soluble resin, and coating the soluble resin with a coating resin layer (see U.S. Pat. No. 5,478,606). The coating resin contains an epoxy resin in a solid form at room temperature. The soluble resin layer can be removed by being dissolved after the formation of the coating resin layer, whereby a desired ink flow path is formed. According to such production method, a minute distance between the ink discharge energy generating element and the ink discharge port can be set with high precision and excellent reproducibility, whereby an ink jet recording head capable of performing high-quality recording can be provided.

Further, in such ink jet recording head, an insulating film is generally formed as a protective film for the ink discharge energy generating element and the like on the substrate. Further, in a case of using a heat element for the ink discharge energy generating element, an anti-cavitation layer such as a Ta film is provided. In connecting a resin forming the ink flow path to such substrate, there is known a method of interposing an adhesion enhancing layer made of a polyether amide resin so as to enhance the adhesion with respect to the substrate (see U.S. Pat. No. 6,390,606).

FIGS. 8A to 8F are cross-sectional schematic views showing basic production steps of an exemplary recording head adopting such prior art in a time series.

In a stage shown in FIG. 8A, a plurality of ink discharge energy generating elements 53 are formed on the surface of the substrate 51, and coated with a protective film 55. Further, on the surface of the substrate 51, a sacrifice layer 54 to be used in a later step of forming an ink supply port 64 is formed, and the back surface of the substrate 51 is entirely coated with a $SiO_2$ film 52.

After that, as shown in FIG. 8B, front and back surfaces of the substrate 51 are coated with the polyether amide resin to form an adhesion enhancing layer 56 and a back surface patterning layer 57, and cured by baking. Then, the polyether amide resin layers are patterned. The patterning can be performed by applying a positive resist by spin coating or the like, exposing the resist to light, followed by developing, and removing the polyether amide resin layer by dry etching or the like, using the positive resist as a mask.

Then, as shown in FIG. 8C, the front surface is coated with a positive resist, followed by patterning, whereby a nozzle flow path molding material 58 is formed. Then, as shown in FIG. 8D, the molding material 58 is coated with a coating photosensitive resin (CR) 59 by spin coating or the like. An ink discharge port 61 is formed by exposing the coating photosensitive resin 59 to UV-light, Deep UV-light, or the like, followed by developing and patterning. A water repellent material 60 is formed on the coating photosensitive resin 59 by lamination or the like of a dry film.

Next, as shown in FIG. 8E, a protective material 62 is applied by spin coating or the like, and the front and side surfaces of the substrate 51 with the molding material 58, the coating photosensitive resin 59, and the like formed thereon are coated with the protective material 62. Further, the $SiO_2$ film 52 on the back surface of the substrate 51 is etched, using the polyether amide resin 57 as a mask. As a result, a Si surface is exposed to be an etching initiation surface 63 for forming the ink supply port 64.

Next, as shown in FIG. 8F, the ink supply port 64 is formed in the substrate 51. The ink supply port 64 is formed by performing chemical etching, for example, anisotropic etching with a strong alkaline solution such as TMAH with respect to the substrate 51. When the anisotropic etching is performed from the back surface, an etching region reaches the sacrifice layer 54 on the surface, whereby the formation of the ink supply port 64 is completed. Next, the back surface patterning layer 57 and the protective material 62 are removed. Further, the molding material 58 is eluted from the ink discharge port 61 and the ink supply port 64, whereby the ink flow path 65 is formed.

In recent years, an increase in density has been required in the ink jet recording head, and there has been a demand for further refined ink flow path pattern. On the other hand, in the above-mentioned prior art, the ink flow path pattern is formed by patterning the molding material 58, and in connecting the coating photosensitive resin 59 onto the substrate 51, the adhesion enhancing layer 56 is interposed so as to enhance the adhesion therebetween. According to such production method, a finished dimension tolerance for both the molding material 58 and the adhesion enhancing layer 56 need to be considered for setting the ink flow path pattern. This restricts an increase in fineness of the ink flow path pattern. Further, there is a possibility that the finished tolerance of the adhesion enhancing layer 56 and the molding material 58 may influence compositively the adhesion and discharge performance of the coating photosensitive resin 59 and the substrate 51.

Further, according to a conventional production method, a material of a member forming a flow path wall is the same as that of a member forming a discharge port. Therefore, in selecting the material, there is a trade-off relationship as the following. That is, use of a material enhancing the adhesion with respect to the substrate becomes disadvantageous to the formation of the discharge port, and in contrast, when a material advantageous for the formation of the discharge port is selected, the adhesion with respect to the substrate is degraded.

SUMMARY OF THE INVENTION

The present invention is directed to a liquid discharge head capable of simultaneously achieving an increase in precision of the formation of a flow path and/or a discharge port, and securing of connection reliability between a flow path wall and a substrate, and a production method thereof.

In one aspect of the present invention, a liquid discharge head includes an energy generating element configured to generate energy required for discharging a liquid, a substrate having the discharge energy generating element formed thereon, and an orifice member provided on the substrate and including a plurality of discharge ports facilitating discharging the liquid and a plurality of flow paths communicating respectively with the plurality of discharge ports. The orifice member includes a first resin forming a portion connected to at least the substrate and a second resin connected to the first resin and forming the plurality of discharge ports, and the first resin includes a silane material in a larger amount than the second resin.

According to another aspect of the present invention, a method of producing a liquid discharge head includes forming a portion to be connected to at least the substrate of the orifice member with a first resin on a surface of the substrate on which the discharge energy generating element is formed; applying and forming a molding material to coat the first resin on the surface of the substrate; polishing the molding material until the surface on a front surface side of the substrate in the portion formed of the first resin is exposed; applying and forming a second resin on the first resin and the polished surface of the molding material; forming the discharge port in the second resin; and removing the molding material.

According to the present invention, in the orifice member, materials respectively suitable for a portion forming the flow path wall and a portion forming the discharge port can be used. Therefore, the discharge port with high precision can be formed while the adhesion with respect to the substrate is secured. Consequently, a liquid discharge head with high reliability, high precision, and high recording quality can be provided at low cost.

Further features of the present invention will become apparent from the following description of exemplary embodiments with reference to the attached drawings.

DESCRIPTION OF THE EMBODIMENTS

Hereinafter, the embodiments of the present invention will be described with reference to the drawings.

The present invention generally relates to a liquid discharge head for ejecting a liquid to form a flying liquid droplet, and providing the liquid droplet to a desired position of a substrate. As such liquid discharge head, well known is an ink jet recording head for causing an ink droplet to adhere to a recording medium, thereby performing desired recording.

Such ink jet recording head is applicable to apparatuses such as a printer, a copier, a facsimile having a communication system, a word processor having a printer portion, and an industrial recording apparatus combined compositively with various kinds of processing devices. Those apparatuses may have a configuration in which recording is performed with respect to a recording medium such as paper, thread, fiber, cloth, leather, metal, plastic, glass, wood, and ceramics.

Further, in the present invention, "recording" refers not only to provision of an image having a meaning such as characters and graphics but also an image having no meaning such as a pattern, to a recording medium.

Embodiment 1

Figure 1:
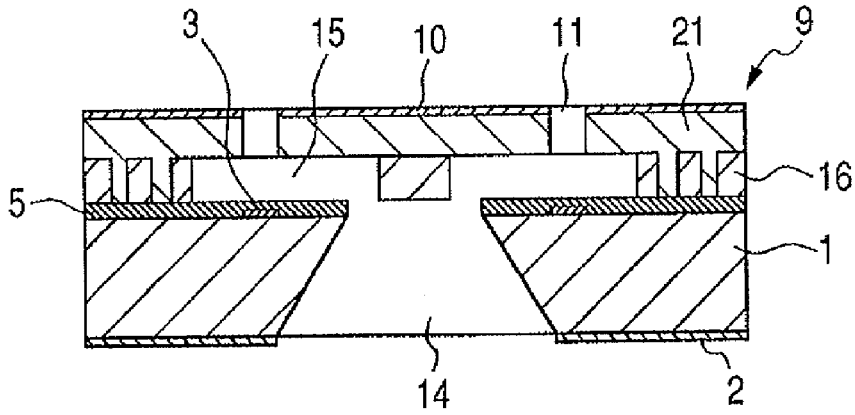
FIG. 1 is a schematic cross-sectional view of an ink jet recording head of Embodiment 1 of the present invention.
Figure 2:
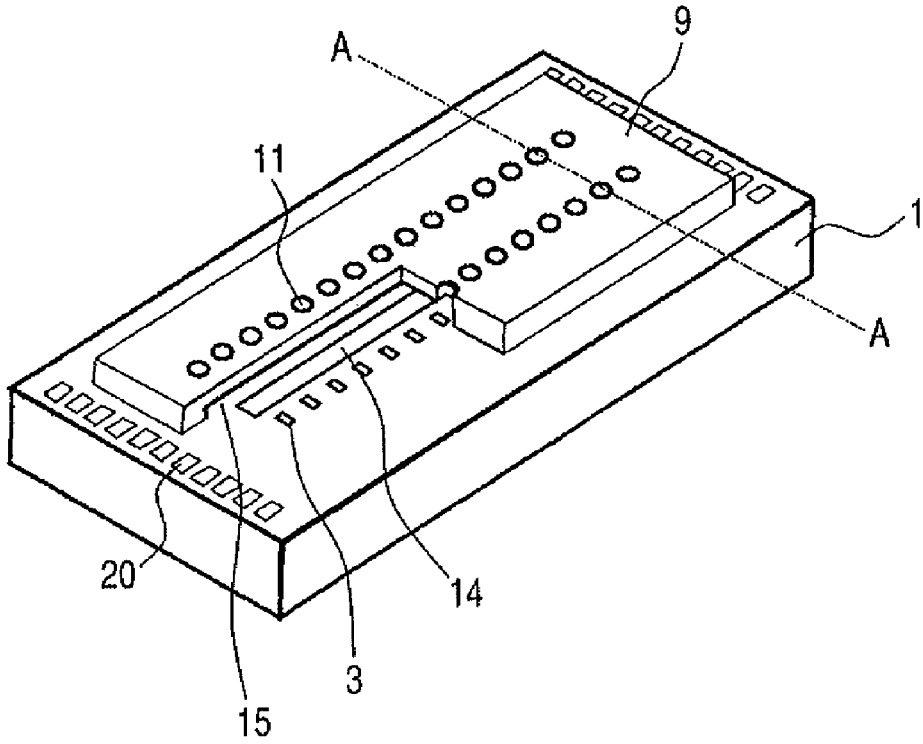
FIG. 2 is a partially cut-away perspective view of the ink jet recording head shown in FIG. 1.

FIGS. 1 and 2 schematically show an ink jet recording head as a liquid discharge head of Embodiment 1. FIG. 2 is a partially cut-away perspective view, and FIG. 1 is a cross-sectional view taken along the line A-A of FIG. 2.

The ink jet recording head has a Si substrate 1 on which ink discharge energy generating elements (discharge energy generating elements) 3 are arranged in two rows at a predetermined pitch. The Si substrate 1 is provided with an ink supply port 14 formed as a through hole, which is opened between two rows of the ink discharge energy generating elements 3. On the Si substrate 1, bonding pads 20 for electrical connection with the outside are formed. Although not shown in detail, a circuit connecting each bonding pad 20 to each ink discharge energy generating element 3 is also formed. Further, on those components, a protective film 5 for protecting the ink discharge energy generating elements 3 and the like from ink is formed. Further, on the Si substrate 1, ink discharge ports 11 that are opened at positions facing the respective ink discharge energy generating elements 3, and an ink flow path (liquid flow path) 15, through which communication is established from the ink supply port 14 to each ink discharge port 11, are formed by an orifice member 9. The orifice member 9 is constituted by two kinds of photosensitive resins 16 and 21, as is understood from the later description of production steps in this embodiment.

The ink jet recording head is usually used under the condition of being incorporated in a recording apparatus. The ink jet recording head is placed so that the surface on which the ink supply port 14 is formed faces a recording surface of a recording medium during a recording operation by a recording medium transport mechanism of the recording apparatus, a scanning mechanism of the recording head, or the like. Then, the ink discharge energy generating elements 3 are driven selectively in accordance with a desired recording image. Consequently, the ink (i.e., liquid) filling the ink flow path 15 is supplied with pressure via the ink supply port 14, and an ink droplet is discharged from the ink discharge port 11. The discharged ink droplet adheres to a predetermined position of the recording medium, and such ink adhesion step is repeated, whereby recording is performed in accordance with a desired recording image.

In particular, the ink jet recording head of this embodiment may have a configuration of causing heat energy to act on the ink to obtain a driving force for discharging a liquid droplet. To be more specific, in this case, the ink on which heat energy acts is overheated, whereby a bubble is generated in the ink. The ink is pushed out from the ink discharge port 11 by the acting force based on the generation of the bubble, whereby an ink droplet is formed. The ink discharge energy generating element 3 can be configured by using a heat generating resistant layer as an electrothermal transducing element serving as a mechanism for generating heat energy. Under the heat generating resistant layer, an underlying layer for accumulating heat can be provided.

Next, a method of producing an ink jet recording head of this embodiment will be described with reference to FIGS. 3A to 3F and 4A to 4C. FIGS. 3A to 3F and 4A to 4C correspond to a cross-sectional view taken along the A-A line of FIG. 2, and show representative respective production steps in a time series.

Figure 3A:
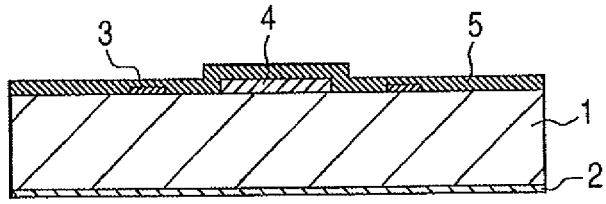
FIGS. 3A, 3B, 3C, 3D, 3E and 3F are schematic cross-sectional views showing basic production steps of the ink jet recording head shown in FIG. 1.

In the stage shown in FIG. 3A, the ink discharge energy generating elements 3 are formed on the surface of the Si substrate 1. Further, a sacrifice layer 4 used for forming the ink supply port 14 to be described later is formed between two rows of the ink discharge energy generating elements 3. Although not shown, a circuit including wiring and a semiconductor element used for driving the ink discharge energy generating elements 3 is also formed on the Si substrate 1. On those components, the protective film 5 is formed. Further, the entire back surface of the Si substrate 1 is coated with a $Si0_2$ film.

Figure 3B:
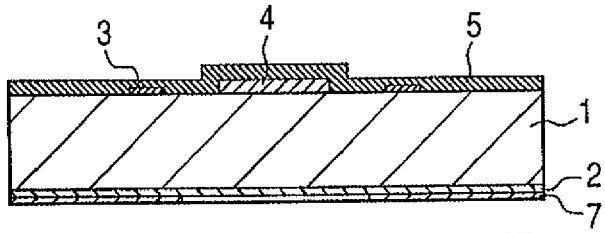
Figure 7A:
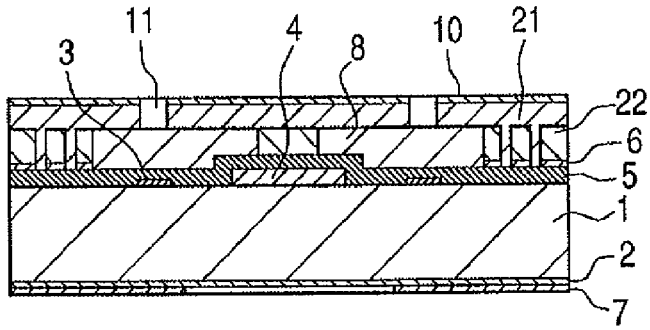
FIGS. 7A, 7B and 7C are schematic cross-sectional views showing basic production steps of the ink jet recording head shown in FIG. 5.
Figure 7B:
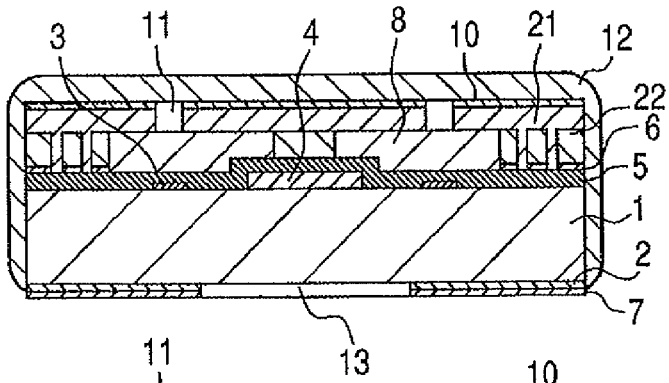
Figure 7C:
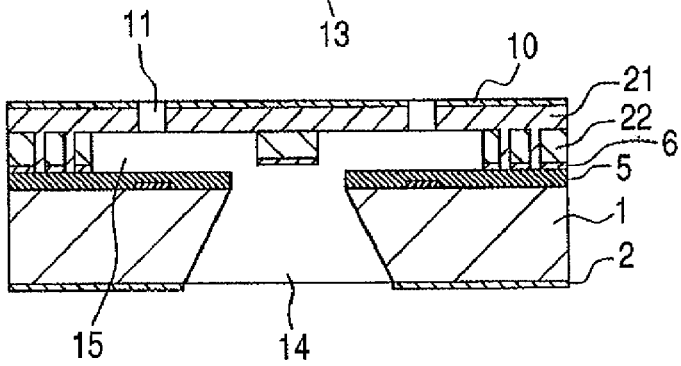
Figure 8A:
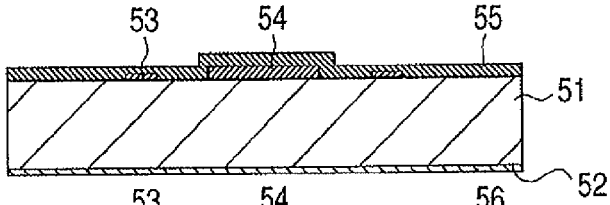
FIG. 8A (PRIOR ART)
FIGS. 8A, 8B, 8C, 8D, 8E and 8F are schematic cross-sectional views showing basic production steps of a conventional ink jet recording head.
Figure 8B:
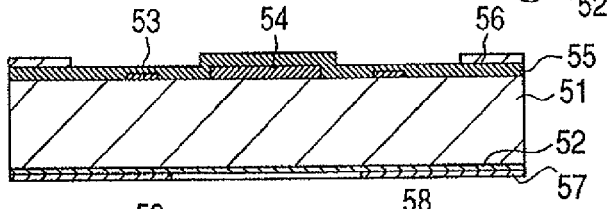
FIG. 8B (PRIOR ART)
Figure 8C:
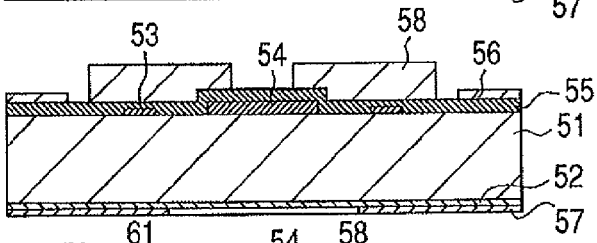
FIG. 8C (PRIOR ART)
Figure 8D:
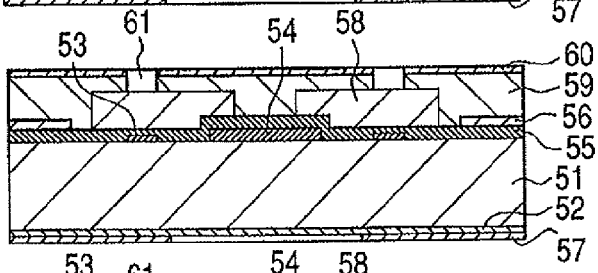
FIG. 8D (PRIOR ART)
Figure 8E:
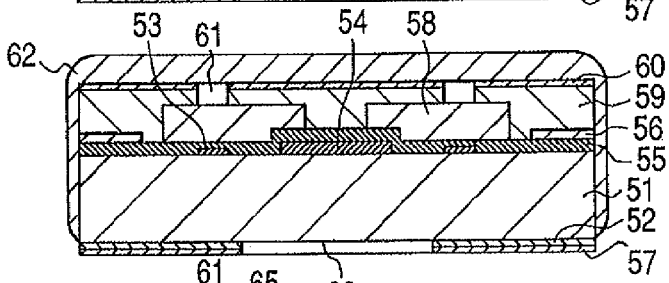
FIG. 8E (PRIOR ART)
Figure 8F:
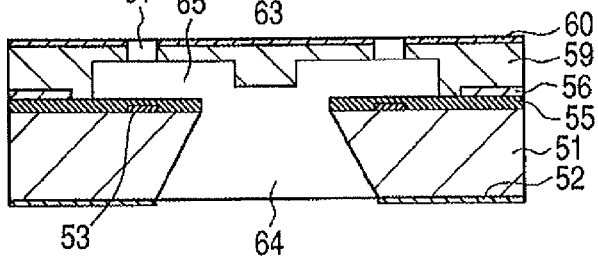
FIG. 8F (PRIOR ART)

From this state, first, as shown in FIG. 3B, a back surface patterning layer 7 made of a polyether amide resin, which is used for forming the ink supply port 14 to be described later, is formed on the back surface of the Si substrate 1. The back surface patterning layer 7 is patterned so as to have an opening corresponding to an etching starting surface 13 (shown in FIG. 7B) during the formation of the ink supply port 14 to be described later. The back surface patterning layer 7 can be patterned by applying a positive resist by spin coating or the like, exposing the positive resist to light, followed by development, and performing dry etching or the like using the positive resist as a mask. After the patterning, the positive resist is peeled. Needless to say, the patterning on the back surface may be performed under the condition that the front surface side of the Si substrate 1 is protected.

Figure 3C:
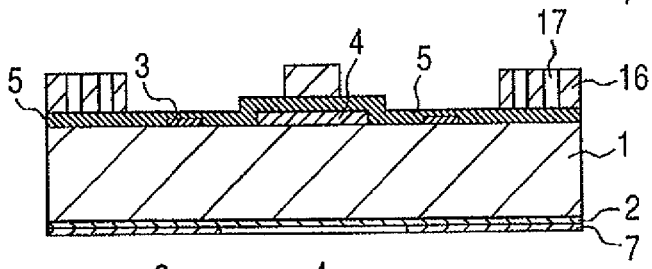

Next, as shown in FIG. 3C, a photosensitive resin (i.e., first resin) 16 having satisfactory adhesion with the protective film 5 is applied by spin coating or the like, and patterned by light exposure with UV-light or the like and developed. The photosensitive resin 16 is formed at least in a portion to be a side wall of the ink flow path 15 that is connected to the Si substrate 1, and a hole portion 17 opened on an upper surface side is formed. The photosensitive resin 16 is compounded by adding a silane material in a larger amount than a normal amount in addition to a cationic photopolymerization initiator so as to enhance the adhesion with the Si substrate 1. Consequently, the photosensitive resin 16 has sufficient adhesion with the Si substrate 1 (i.e., protective film 5) even without an adhesion enhancing layer interposed therebetween as in the prior art. Considering the adhesion with the photosensitive resin 16 containing a large amount of silane material, a protective film formed of an inorganic-based material such as plasma SiN or plasma SiO can be used as the protective film 5.

Figure 3D:
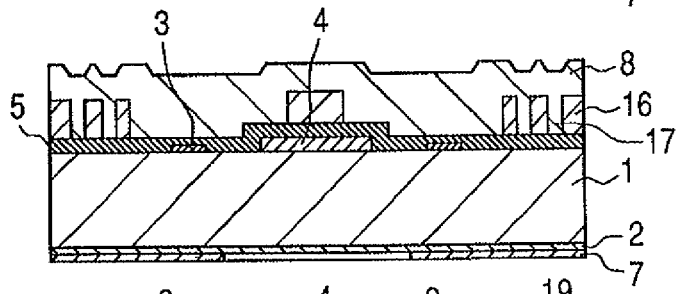
Figure 3E:
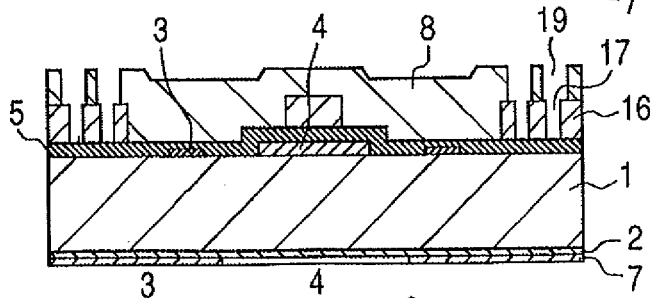

Next, as shown in FIG. 3D, a molding material (ODUR, produced by Tokyo Ohka Kogyo Co., Ltd.) 8 is applied by spin coating, followed by baking. The molding material 8 has a function of preventing flow path side walls from collapsing during chemical mechanical polishing (CMP) in the later step. A positive material can be used for the molding material 8. Then, as shown in FIG. 3E, the molding material 8 in the hole portion 17 formed in FIG. 3C is exposed to light and developed to be removed, whereby a molding material patterning portion 19 is formed.

Figure 3F:
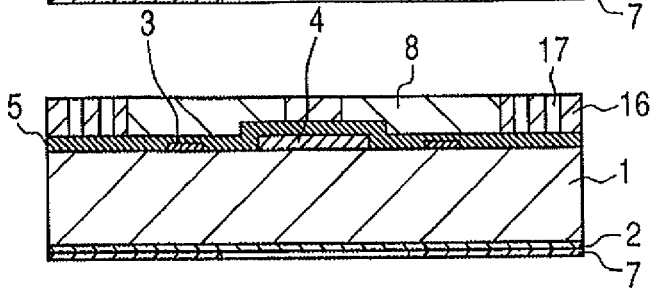

Next, as shown in FIG. 3F, chemical mechanical polishing is performed from the upper surface of the molding material 8 until the upper surface of the flow path side wall portions formed of the photosensitive resin 16 is exposed, followed by cleaning. In this case, needless to say, the chemical mechanical polishing is performed under optimum conditions by tuning a polishing condition, i.e., a pressure, a rotation number, a polishing solution (containing alumina, silica, etc.), and the like so as to prevent or suppress the formation of scratches (i.e., minute flaws) and dishing (i.e., unevenness ) on the polished surface.

Figure 4A:
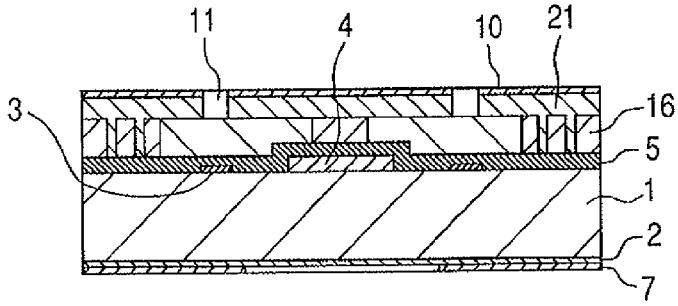
FIGS. 4A, 4B and 4C are schematic cross-sectional views showing basic production steps of the ink jet recording head shown in FIG. 1.

Next, as shown in FIG. 4A, a photosensitive resin (i.e., second resin) 21 made of the same kind of material as that of the photosensitive resin 16 used for forming the flow path side walls is applied by spin coating or the like. At this time, the photosensitive resin 21 enters the hole portion 17 formed in the previous step. The photosensitive resin 21 is not soluble with the ODUR of the molding material 8, and is compounded with a cationic photopolymerization initiator similar to that of the photosensitive resin 16. However, in order to form the ink discharge port 11 in a predetermined shape with high precision, the amount of a silane agent to be added is set to be small, unlike the photosensitive resin 16. Herein, as the photosensitive resins 16 and 21, a resin composition at least containing an epoxy resin which is cationic polymerizable and an aromatic onium salt are used. To be specific, as the epoxy resin which is cationic polymerizable, there is a reaction product of bisphenol A and epochlorohydrin, and a reaction product of phenol novolak or o-cresol novolak and epichlorohydrin. Further, there is a polyfunctional epoxy resin having an oxycyclohexane skeleton and the like disclosed in Japanese Patent Application Laid-Open No. S60-161973, Japanese Patent Application Laid-Open No. S63-221121, Japanese Patent Application Laid-Open No. S64-009216, and Japanese Patent Application Laid-Open No. H02-140219. On the other hand, examples of the aromatic onium salt include an aromatic iodonium salt, an aromatic sulfonium salt, and SP-170 and SP-150 provided by Asahi Denka Kogyo K.K. In those resin compositions, an aromatic onium salt is decomposed by light irradiation to initiate the cationic polymerization of an epoxy resin, whereby a cured film can be formed. Other than those described above as the epoxy resin, Epon SU-8 (Product name, produced by Shell Chemicals Japan Ltd.) may be used.

The ink discharge port 11 is formed by performing light exposure with UV-light or the like and development with respect to the photosensitive resin 21. Further, a water repellent material 10 is formed on the photosensitive resin 21 by lamination of a dry film or the like.

Figure 4B:
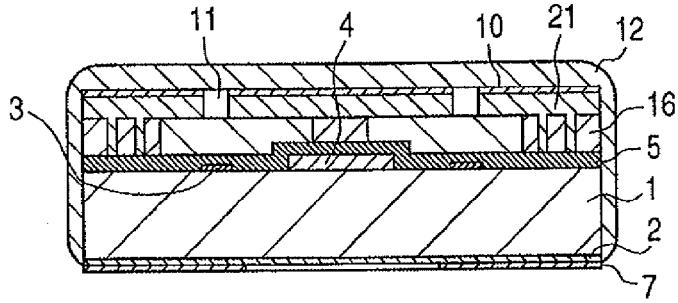

Next, as shown in FIG. 4B, a protective material 12 is applied by spin coating or the like, thereby coating the front surface and side surfaces of the Si substrate 1 with the molding/protective material 12, the photosensitive resins 16 and 21, and the like patterned thereon. The protective material 12 has a function of preventing flaws during the transportation of an apparatus or the like, protecting the photosensitive resins 16 and 21 from a strong alkaline solution to be used at a time of anisotropic etching in the later step, and preventing degradation of the water repellent material 10 or the like. Thus, the protective material 12 can be one having sufficient resistance to the strong alkaline solution.

Next, the $SiO_2$ film 2 on the back surface of the Si substrate 1 is patterned by wet etching, using the back surface patterning layer 7 as a mask. Consequently, a Si surface that will be the etching starting surfaces 13 for anisotropic etching is exposed.

Figure 4C:
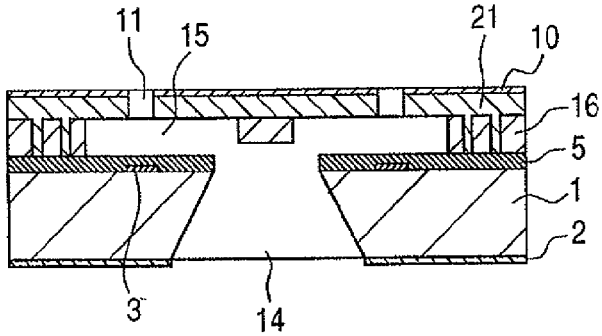
Figure 5:
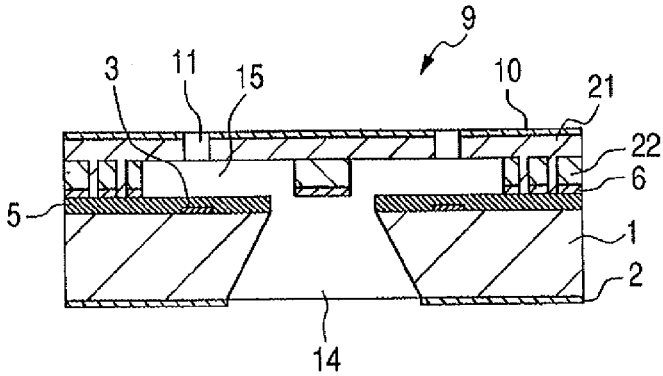
FIG. 5 is a schematic cross-sectional view of an ink jet recording head of Embodiment 2 of the present invention.

Next, as shown in FIG. 4C, the ink supply port 14 is formed. In this embodiment, the ink supply port 14 is formed by anisotropic etching, using the $SiO_2$ film 2 as a mask and utilizing a crystal orientation <100> of the Si substrate 1. For the anisotropic etching, for example, a strong alkaline solution such as TMAH is used. The etching is started from the etching starting surface 13, and is carried out until the sacrifice layer 4 formed on the front surface side of the Si substrate 1 is reached. The sacrifice layer 4 is formed of a material having a higher etching speed with an alkaline solution, such as polysilicon, aluminum, aluminum silicon, aluminum copper, or aluminum silicon copper. In this embodiment, although etching using a crystal orientation <100> of the Si substrate 1 is adopted, a crystal orientation <110> may be used.

Next, the back surface patterning layer 7 is removed. Further, the molding material 8 is eluted from the ink supply port 14. The elution of the molding material 8 can be executed by exposing the front surface to Deep UV-light, followed by development and drying. If required, at a time of development, the molding material 8 can be removed sufficiently by ultrasonic soaking. As a result of the removal of the molding material 8, an ink flow path 15 is formed. The ink flow path 15 in the present specification may include a bubble generation chamber and the like formed so that the pressure generated by the ink discharge energy generating element 3 acts on the ink discharge port 11 side effectively.

As a result of the above-mentioned steps, the main configuration of the ink jet recording head of this embodiment is completed. Although not shown, the ink jet recording head may be configured in such a manner that a chip tank member for ink supply is connected to the ink supply port 14, and a member for electrical connection with a recording apparatus is electrically connected to the bonding pad 20. Further, a plurality of ink jet recording heads can be produced simultaneously on one Si substrate 1 by the above-mentioned steps. In this case, the Si substrate 1 is cut, separated, and chipped with a dicing saw.

In the ink jet recording head of this embodiment as described above, in the orifice member 9, the different photosensitive resins 16 and 21 are used respectively for a portion to be a side wall of the ink flow path 15 and a portion in which the ink discharge port 11 is formed. Then, as the photosensitive resin 16 in the side wall portion of the ink flow path 15, a silane material is incorporated in a larger amount compared with the photosensitive resin 21, whereby a material excellent in the adhesion with the Si substrate 1 is used. On the other hand, as the photosensitive resin 21 in the portion in which the ink discharge port 11 is formed, a material suitable for forming the ink discharge port 11 with high precision is used. Thus, securing of the adhesion between the orifice member 9 and the substrate 1, and formation of the ink discharge port 11 with high precision can be achieved simultaneously. In this case, the photosensitive resin 21 enters the hole portion 17 of the photosensitive resin 16, thereby being fitted in the photosensitive resin 16. Therefore, even in a case where the adhesion sufficient for the Si substrate 1 is not obtained with the photosensitive resin 21 alone, the orifice member 9 is connected sufficiently strong with respect to the Si substrate 1. Herein, the photosensitive resin 21 should contain a silane material in a smaller amount compared with the photosensitive resin 16. However, the photosensitive resin can be used in the present invention even if it does not contain a silane material at all.

Further, according to the configuration of this embodiment, the adhesion enhancing layer as in the prior art is not required. Therefore, the restriction of setting an ink flow path pattern can be reduced due to the absence of the influence of a dimension tolerance of the adhesion enhancing layer, and a pattern to be formed can be made finer. Thus, an ink jet recording head of high recording quality can be provided. Further, the connection reliability of the orifice member 9, and the precision of a pattern to be formed can be enhanced, whereby an ink jet recording head having high reliability and satisfactory discharge performance can be produced. Further, according to this embodiment, an expensive material is not required, so production at low cost can be achieved.

Embodiment 2

Embodiment 2 will be described with reference to FIGS. 5, 6A to 6F, and 7A to 7C. FIGS. 6A to 6F and 7A to 7C show production steps of an ink jet recording head according to the embodiment shown in FIG. 5 in a time series in cross-sectional views similar to those of FIGS. 3A to 3F and 4A to 4C. The main configuration of the ink jet recording head is the same as that of Embodiment 1, so the description thereof will be omitted. Further, in FIGS. 6A to 6F and 7A to 7C, the same components as those in Embodiment 1 are denoted by the same reference numerals as those therein.

Figure 6A:
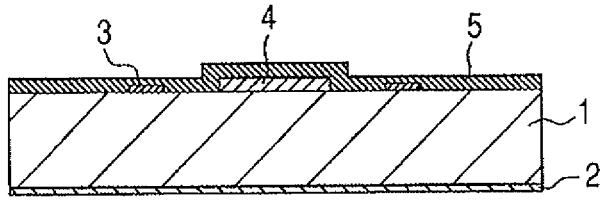
FIGS. 6A, 6B, 6C, 6D, 6E and 6F are schematic cross-sectional views showing basic production steps of the ink jet recording head shown in FIG. 5.
Figure 6B:
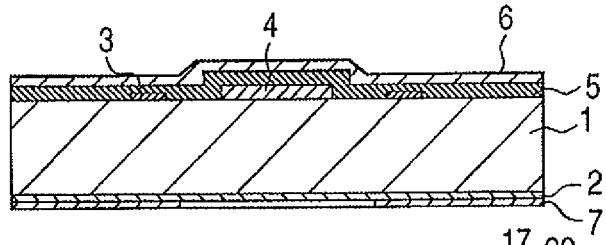

The configuration of the stage shown in FIG. 6A is the same as that of the stage in Embodiment 1 shown in FIG. 3A. From this state, as shown in FIG. 6B, a back surface patterning layer 7 used for forming an ink supply port 14 is formed on the back surface of the Si substrate 1, which is also the same as in Embodiment 1.

Next, a thermoplastic polyether amide resin 6 is applied to the entire front surface of the Si substrate 1, followed by curing. The polyether amide resin 6 has high adhesion with a photosensitive resin 22 (shown in FIG. 6C) for forming a side wall of the ink flow path 15 to be used in the subsequent step, and functions as an adhesion enhancing layer.

Figure 6C:
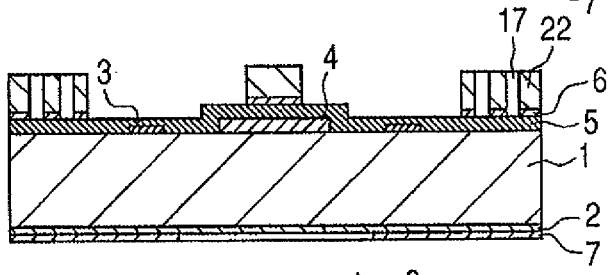
Figure 6D:
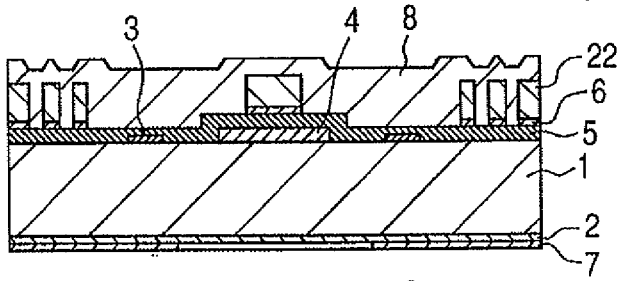
Figure 6E:
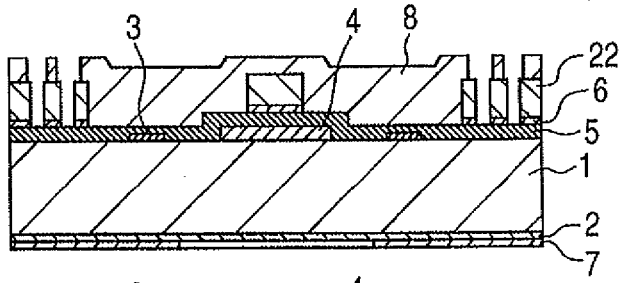
Figure 6F:
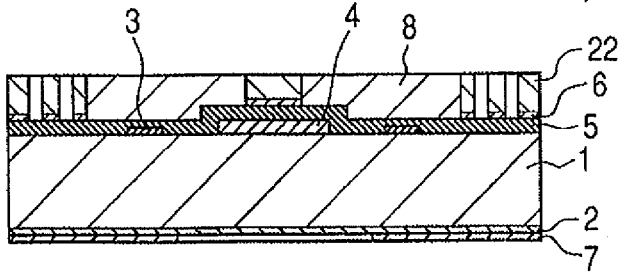

Next, as shown in FIG. 6C, the photosensitive resin (i.e., first resin) 22 is applied onto the polyether amide resin 6 by spin coating or the like, exposed to UV-light or the like, and followed by development, whereby the photosensitive resin 22 is patterned. Thus, the photosensitive resin 22 is configured so as to have at least a portion to be a side wall of the ink flow path 15, and a hole portion 17 that is opened to the upper surface side is formed, which is the same as in Embodiment 1. In this case, the photosensitive resin 22 to be used is compounded with a cationic photopolymerization initiator so as to enhance the adhesion with the polyether amide resin 6 serving as the adhesion enhancing layer. After that, the polyether amide resin 6 is patterned by etching, using the photosensitive resin 22 as a mask.

The subsequent steps are the same as those in Embodiment 1. To be more specific, the molding material 8 is applied (see, FIG. 6D), the molding material 8 in the hole portion 17 is removed (see, FIG. 6E), and the molding material 8 is polished (see, FIG. 6F). Then, the second resin 21 is applied, and the ink discharge port 11 is formed in a portion formed of the second resin 21 (see, FIG. 7A). The water repellent material 21 is formed arbitrarily, which is also the same as in Embodiment 1. Then, the front surface and the side surfaces of the substrate 1 are protected by the protective material 12 (see, FIG. 7B), the ink supply port 14 is formed, and the molding material 8 is eluted. In the above-mentioned embodiments, the configuration in which the photosensitive resins 16 and 21 are fitted has been described. However, the present invention is not limited thereto. For example, the production method described in U.S. Pat. No. 6,390,606 may be used. That is, an ink flow path pattern made of a positive resist ODUR is formed on a substrate, and after that, the photosensitive resin 16 is applied. Further, the photosensitive resin 21 is applied thereto, whereby a discharge port is formed. Thus, the present invention can be applied. Accordingly, in the present invention, the photosensitive resins are not necessarily fitted in each other.

As a result of the above-mentioned steps, the main configuration of the ink jet recording head of this embodiment is completed. If required, chipping with a dicing saw and connection of a chip tank member and a member for electrical connection are performed.

Even in the ink jet recording head of this embodiment as described above, the orifice member 9 is mainly constituted by the photosensitive resin 22 forming a flow path wall, and the photosensitive resin 21 forming a portion in which the ink discharge port 11 is formed. As a result, the securing of the adhesion between the orifice member 9 and the Si substrate 1, and the formation of the ink discharge port 11 with high precision can be achieved simultaneously. Further, in this embodiment, the polyether amide resin 6 is interposed as an adhesion enhancing layer between the orifice member 9 and the Si substrate 1, whereby the connection reliability between the orifice member 9 and the Si substrate 1 can be further enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-305810, filed Oct. 20, 2005 which is hereby incorporated by reference herein in its entirety.

What is claimed is:

1. A liquid discharge head, comprising:

an energy generating element configured to generate energy required for discharging a liquid;

a substrate having the energy generating element formed thereon; and an orifice member provided on the substrate and including a plurality of discharge ports facilitating discharging the liquid and a plurality of flow paths communicating respectively with the plurality of discharge ports, wherein the orifice member is constituted by a first resin forming a portion connected to at least the substrate and a second resin connected to the first resin and forming the plurality of discharge ports, and the first resin includes a silane material in a larger amount than the second resin.

2. A liquid discharge head according to claim 1, wherein the first resin and the second resin include a photosensitive resin.

3. A liquid discharge head according to claim 1, wherein the second resin excludes a silane material.

* * * * *